US008001820B2

(12) United States Patent
Pawelski et al.

(10) Patent No.: US 8,001,820 B2
(45) Date of Patent: Aug. 23, 2011

(54) METHOD FOR LUBRICATING AND COOLING ROLLERS AND METAL STRIPS ON ROLLING IN PARTICULAR ON COLD ROLLING OF METAL STRIPS

(75) Inventors: Hartmut Pawelski, Ratingen (DE); Ludwig Weingarten, Düsseldorf (DE); Friedhelm Gieseler, Freudenberg (DE); Peter Jollet, Düsseldorf (DE); Hans-Peter Richter, Friedewald (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 675 days.

(21) Appl. No.: 11/989,498

(22) PCT Filed: Aug. 25, 2006

(86) PCT No.: PCT/EP2006/008359

§ 371 (c)(1),
(2), (4) Date: Jan. 25, 2008

(87) PCT Pub. No.: WO2007/025682

PCT Pub. Date: Mar. 8, 2007

(65) Prior Publication Data

US 2009/0282884 A1 Nov. 19, 2009

(30) Foreign Application Priority Data

Sep. 2, 2005 (DE) ..... 10 2005 042 020

(51) Int. Cl.
*B21B 27/06* (2006.01)

(52) U.S. Cl. ..... 72/236; 72/7.4; 72/8.3; 72/201; 700/150

(58) Field of Classification Search ..... 72/7.1, 72/7.4, 8.3, 8.6, 9.1, 10.4, 11.1, 11.4, 11.7, 72/12.3, 201, 236; 700/149, 150, 151, 154
See application file for complete search history.

(56) References Cited

U.S. PATENT DOCUMENTS

| | | | | |
|---|---|---|---|---|
| 5,437,802 | A * | 8/1995 | Kurahashi et al. | 508/116 |
| 5,855,131 | A * | 1/1999 | Schmid et al. | 72/11.7 |
| 6,014,881 | A * | 1/2000 | Imanari | 72/201 |
| 6,598,448 | B1 * | 7/2003 | Barten et al. | 72/201 |
| 6,697,699 | B2 * | 2/2004 | Gramckow et al. | 700/154 |
| 7,159,433 | B2 * | 1/2007 | Seidel | 72/201 |

FOREIGN PATENT DOCUMENTS

| | | |
|---|---|---|
| DE | 199 53 230 | 5/2001 |
| DE | 103 52 546 | 3/2005 |
| EP | 0 367 967 | 5/1990 |
| EP | 0 794 023 | 9/1997 |
| JP | 60 223601 | 11/1985 |
| JP | 62-72409 | * 4/1987 |
| JP | 09239429 | 9/1997 |

* cited by examiner

*Primary Examiner* — Edward Tolan
(74) *Attorney, Agent, or Firm* — Lucas & Mercanti, LLP; Klaus P. Stoffel

(57) ABSTRACT

The invention relates to a method for lubricating and cooling rollers (3,4,5,6) and metal strips (2) on rolling in particular, on cold rolling of metal strips (2), wherein, on the inlet side (7*a*) a minimal amount of pure lubricant (9) without a high water content is continuously supplied in an online controlled manner with a controlled viscosity and lubricity depending on a number of process data measurements (23) by means of a physical computer model (22) and the equivalent process data measurements (23) from the outlet side (8*a*) are also used online by the physical computer model (22).

10 Claims, 3 Drawing Sheets

METHOD FOR LUBRICATING AND COOLING ROLLERS AND METAL STRIPS ON ROLLING IN PARTICULAR ON COLD ROLLING OF METAL STRIPS

The invention concerns a method for lubricating and cooling rolls and metal strip during rolling, especially during the cold rolling of metal strip, where a lubricant is applied by spraying at least on the run-in side and a coolant is applied by spraying on the runout side, and where substances or gases (media) with lubricating, cleaning, and inerting activity or their combinations are supplied to the underside of the rolled strip and/or to the upper side of the rolled strip and/or to the lower work roll and/or to the upper work roll.

EP 0 367 967 B1 discloses a method of this type for cooling and lubricating rolls and rolling stock during cold rolling. In this connection, an oil/water emulsion that contains an oil phase is adjusted in a special emulsifying technique according to partial tensile stresses in the rolled strip or according to the bite conditions between the roll and rolled strip and is regulated by the use of the media to be emulsified according to their quantity and type. The disadvantage is the application of too much oil with a high water content and thus the danger of rust formation on the finished steel strip or scale formation on nonferrous strip. Excessive oil application means that residual amounts of oil remain on the metal strip and must be removed again by additional work steps. Furthermore, if disposal causes environmental pollution, the production costs can be further increased.

DE 199 53 230 C2 also discloses a method for the cold rolling of metal rolling stock, in which the rolling stock is plastically deformed by running it through the roll gap between rolls driven in opposite directions, where inert gas is blown into the region of the roll gap instead of a cooling liquid, and the inert gas has a temperature below room temperature, e.g., the temperature of liquid nitrogen, which temperature is lower than that of the rolling stock.

Therefore, the objective of the invention is to achieve higher production of rolled metal strip of higher quality by eliminating process steps, where better strip quality is to be made possible by a more stable rolling process, especially a frictional adjustment in the roll gap.

In accordance with the invention, this objective is achieved by using a physical computer model 22 to apply, by means of continuous online metering on the run-in side, a minimal amount of pure lubricant without a high water content and with controlled viscosity as a function of the following process data:

- rolled strip speed,
- rolled strip quality,
- rolled strip flatness,
- rolled strip surface (e.g., rolled strip roughness; this is measured online),
- rolled strip tension,
- rolling force (including bending force of the work rolls and intermediate rolls),
- work roll diameter,
- work roll roughness,
- roll material, and by using the process data equivalent to this on the runout side by means of the physical computer model, likewise online.

One of the advantages is better strip quality resulting from a more stable rolling process; in particular, frictional adjustment in the roll gap is made possible. Another advantage is that subsequent oil removal is no longer necessary, so that additional process steps are eliminated. Minimal lubrication means that only as much lubricant is applied on the run-in side as is necessary to achieve the desired product quality. Also eliminated are disposal equipment for oil emulsions and the attendant costs. Fixed process values (e.g., material, strip width, and the like) and process variables that vary during the pass (e.g., strip speed, rolling force, rolling torque, forward slip, strip tension, distribution of strip tension across the strip width, strip temperature, roll temperature, strip thickness, and thickness reduction) can be continuously considered in the online metering of the lubricant on the run-in side. In addition, preservatives (substances that prevent rust and strip cobbles) can be directly used on the run-out side.

In a modification of the invention, the physical computer model takes the following variables into account:

- forecast and optimization for a pass program design,
- an evaluation of the lubricating film by a tribological model,
- a temperature model,
- the elastic deformation of the rolls,
- a mechanical roll gap model,
- a model for optimization of the surface quality,
- a frictional adjustment to the rolling process during reduction rolling or temper rolling or flexible rolling (production of different strip thicknesses),
- a hydrodynamic model, and
- a model for roughness impression between metal strip and work rolls.

These variables can be used for the systematic online adjustment of the application of the media onto the rolls in the roll gap and on the metal strip with a physically based computer model of the rolling process that includes mechanical, thermal, and tribological effects.

Another embodiment provides that, during the rolling process, the following correcting variables for the application of the liquid or gaseous lubricants and coolants are preset on the basis of automatic control by the computer model:

- volume flow,
- pressure,
- temperature,
- different adjustments over the width of the rolled strip,
- and if necessary, different adjustments for the underside and the upper side of the rolled strip.

The advantages consist not only in the rapid adjustment of the correcting variables for the application of the media, but also in the fact that it is possible to undertake, e.g., a change in the mixing proportions of media with different actions, e.g., mixing a substance that has the effect of greatly reducing the roll gap friction and a substance that has little effect on the roll gap friction but has a strong washing effect.

In this regard, it is also advantageous that the mixing proportions of liquid and gaseous media are varied according to a computer program of the physically based model.

In another embodiment, before the beginning of the rolling operation, process data, such as rolling force, strip tension, strip thickness, and the like, are preset in a pass program, which is processed in the computer program.

In a further refinement of the invention, process data are used to preset a closed-loop control system for strip thickness, rolling stock elongation, strip flatness, strip roughness, and/or strip surface.

Further improvement is achieved by presetting a forecast for optimization of the temperature development in the metal strip and/or in the work rolls.

It is also advantageous for a lubricant selection to be made according to the manufacturer's type, viscosity, and temperature behavior.

Optimization of the rolled strip surface by selection of the work roll roughness contributes to quality improvement of the metal strip.

The above measures can also be used during intervals with variable rolling speed with the use of the computer model. In this regard, the following are realized:

adjustment of the desired strip surface (e.g., with respect to roughness or luster and other quality characteristics), adjustment of the desired strip flatness, assurance of process stability (avoidance of strip breakage), and effective utilization of the media.

For so-called flexible rolling (e.g., as a cold rolling process for producing different strip thicknesses over the length of the strip), it is taken into consideration that, with constant lubrication, drastic changes regularly occur in the process state due to the variable thickness reduction over the length of the strip. The strongly variable rolling force allows only limited adjustment of the desired strip flatness. Therefore, in the phases of high thickness reduction, the adjustment of a smaller coefficient of friction in the roll gap makes sense, possibly in combination with an increase in the strip tensions in order at least partially to compensate this effect by increasing the rolling force. This operation can be carried out with the use of the physically based computer model (computer program), taking into account the dependence on the other process parameters, as described above.

Specific embodiments of the invention are illustrated in the drawings and described in detail below.

Figure 1:
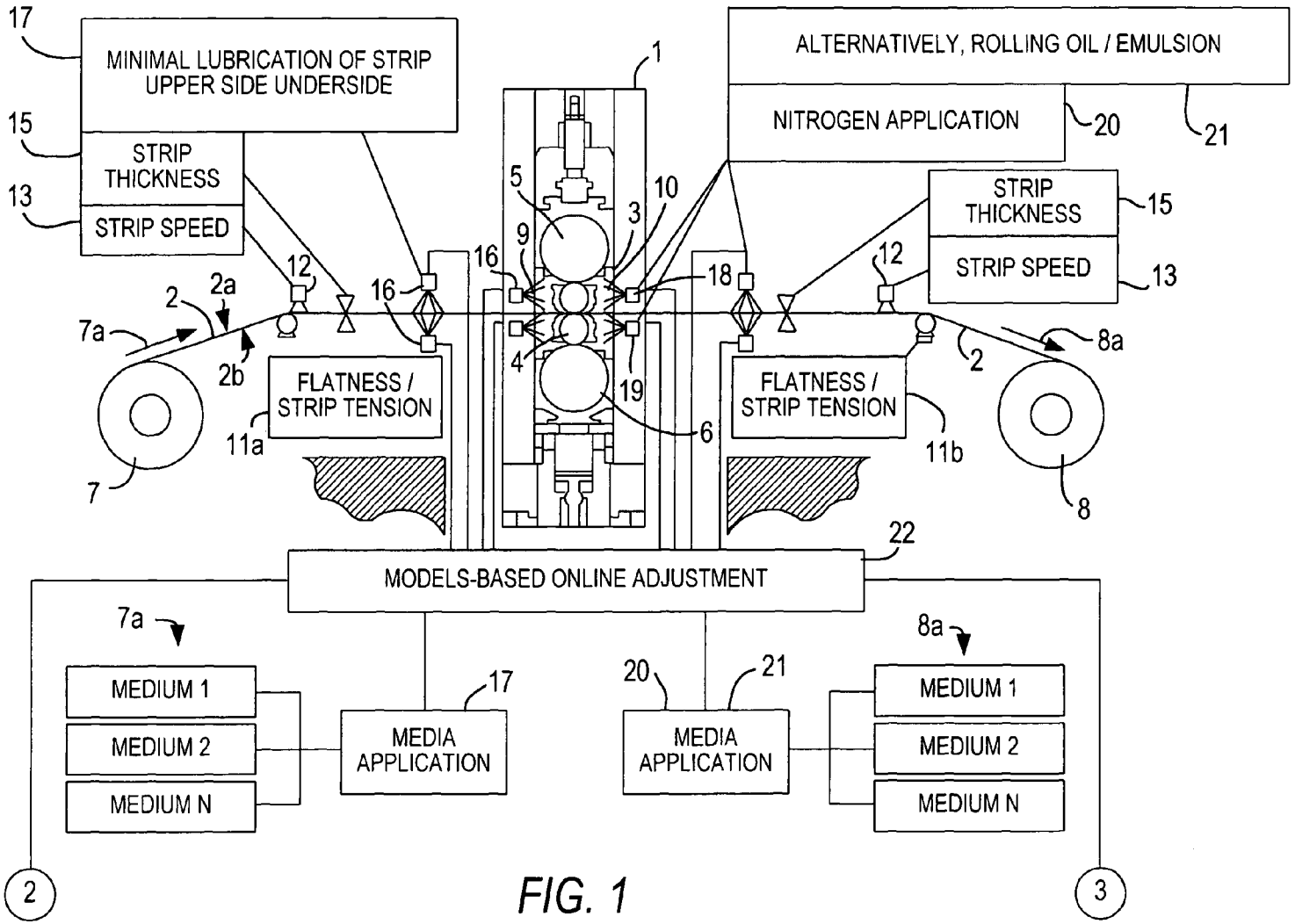
FIG. 1 shows a functional block diagram of a cold rolling mill combined with adjustment elements that are operated on the basis of a model computation (computer model).
Figure 2:
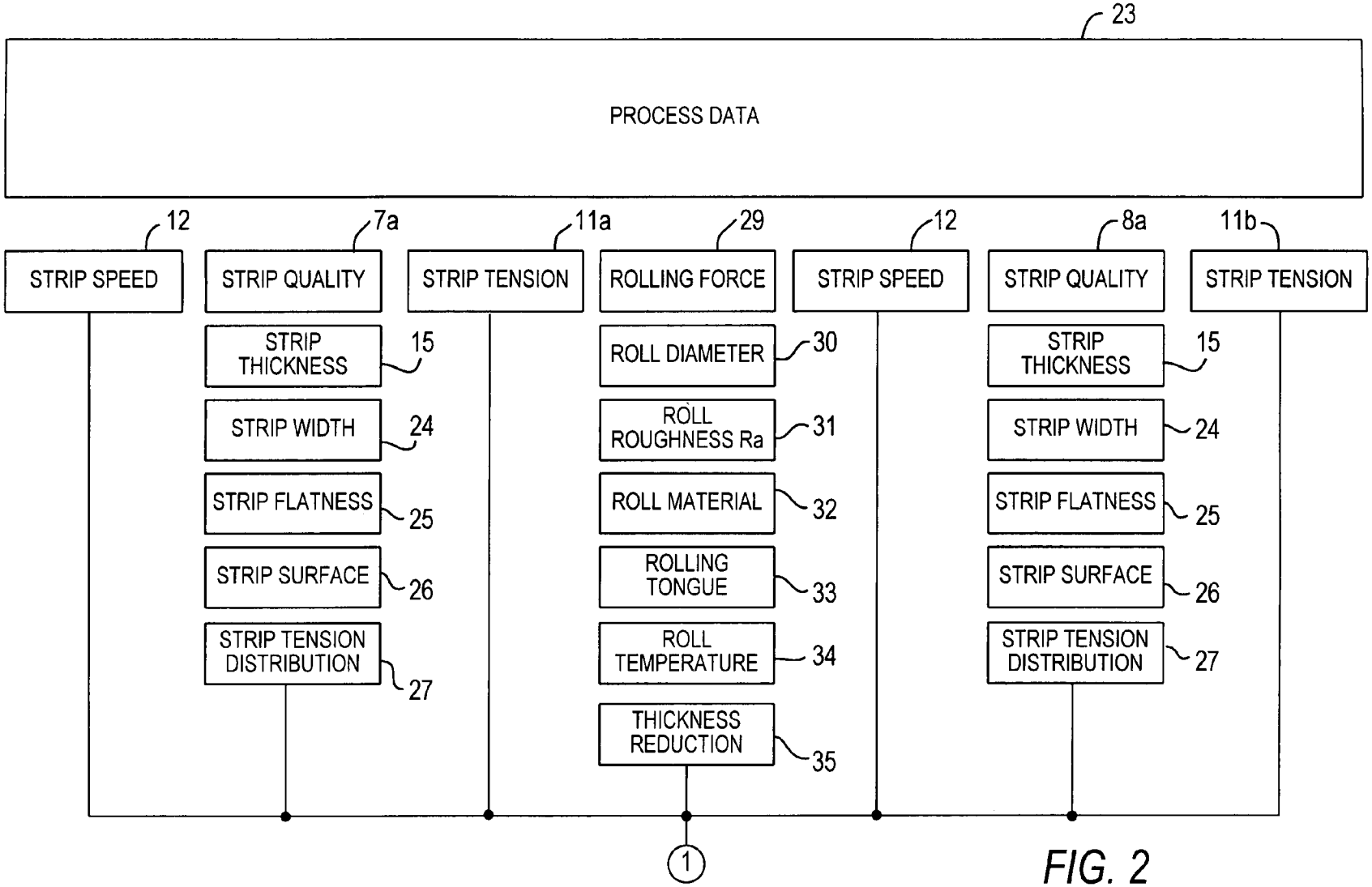
FIG. 2 shows a functional block diagram arrangement of the operating parameters or process data used for a physically based model computation.
Figure 3:
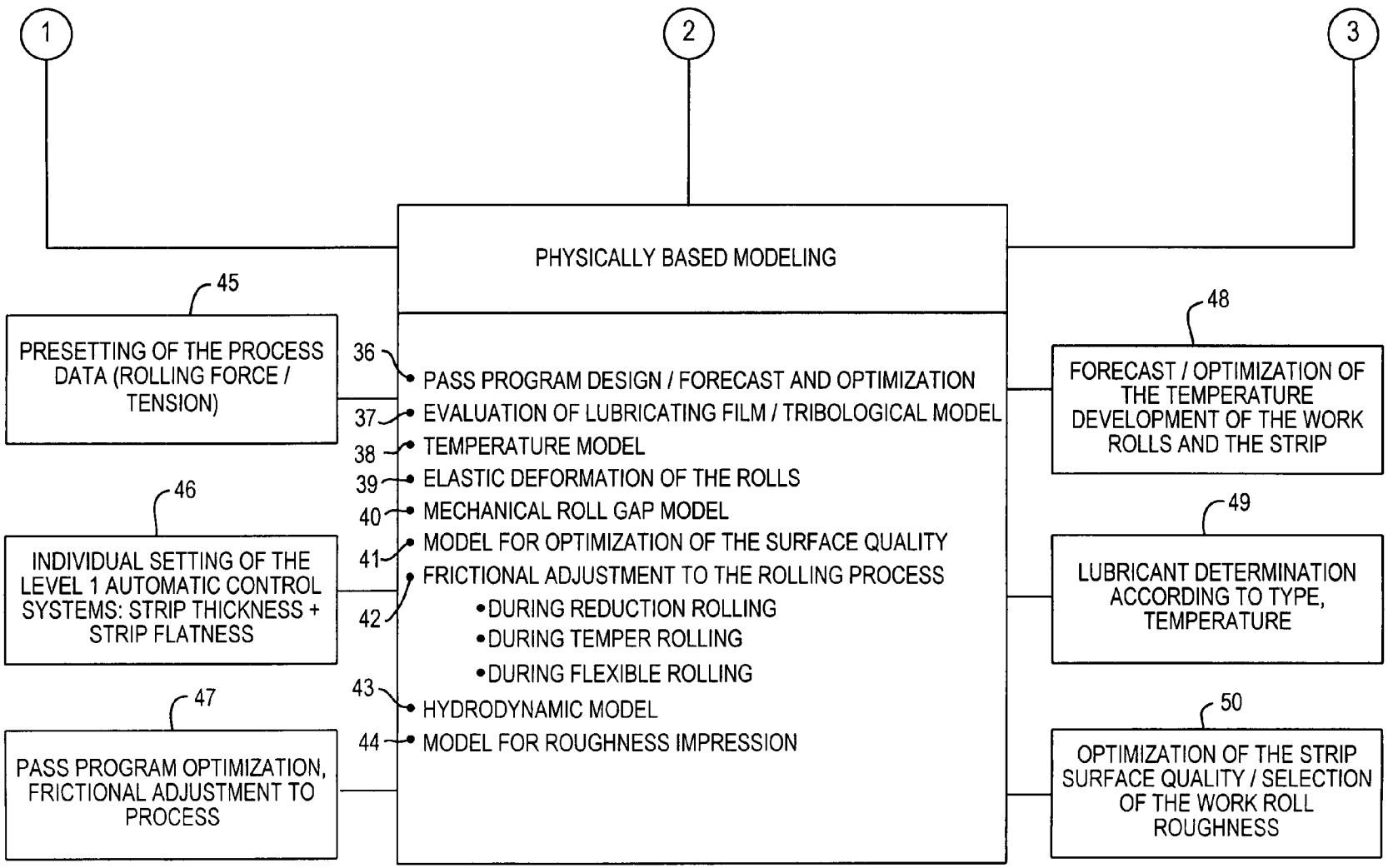
FIG. 3 shows a functional block diagram listing of the parameters that are used in the physically based model computation.

(FIGS. 1 and 3 are joined with each other with "loop 2" and "loop 3." FIGS. 2 and 3 are joined with each other with "loop 1.")

A rolling stand 1 (FIG. 1) for metal strip 2 (e.g., made of heavy metal or light metal of various alloys) has upper and lower work rolls 3, 4, which are supported in chocks between backup rolls 5, 6. FIG. 1 shows a four-high rolling mill. The application described here can be used with all types of rolling mills, such as a six-high rolling mill, a twenty-roll mill, a two-high rolling mill, etc. The metal strip 2 passes from an uncoiling station 7 on the run-in side 7*a* to a coiling station 8 on the runout side 8*a*. On the run-in side 7*a*, a chemical composition that constitutes a pure lubricant 9 is applied by spraying, and on the runout side 8*a*, a coolant 10 is applied by spraying. The lubricant 9 and the coolant 10 consist of substances or gases with lubricating, cleaning, and inerting activity or combinations thereof and are supplied to the underside 2*a* and the upper side 2*b* of the rolling stock. The lubricating substances on the run-in side 7*a* are emulsions that do not have a high water content, emulsion base oils, rolling oils, and/or additive concentrates. The cleaning and inerting substances consist of cryogenic inert gases, e.g., nitrogen, and their combinations with other substances.

The device (FIG. 1) used for this purpose consists of a flatness measuring instrument 11*a* on the run-in side 7*a* and a flatness measuring instrument 11*b* on the runout side 11*b*.

During the passage of the metal strip through the mill, a speed measuring instrument 12 measures the strip speed 13, and other measuring instruments are used to measure various forces acting on the strip, so that it is possible to determine the rolled strip quality 14 that corresponds to the properties of the given metal that is being produced, e.g., aluminum, steel, brass, copper, and the like. The strip thickness 15 is measured continuously and over the width of the metal strip 2. Rows of spray nozzles 16 for supplying lubricant 9 in the systematically determined amount and distribution of minimal lubrication 17 are arranged on the run-in side 7*a* on the underside 2*a* and the upper side 2*b* of the rolling stock. Similar rows of spray nozzles 16 are arranged in the rolling stand 1 for lubricating the upper and lower work rolls 3, 4 and the upper and lower backup rolls 5, 6.

Upper rows of spray nozzles 18 and lower rows of spray nozzles 19 are provided on the runout side 8*a* for the application of nitrogen 20 for cooling and inerting and, alternatively, if necessary, for the application 21 of lubricant 9.

The variable amounts of all substances for lubricating and cooling are determined according to the computationally or empirically determined values of the model computation of a computer model 22, and the corresponding signals are transmitted to the respective actuators in the control devices connected to the measuring instruments. This makes the rolling process, especially the cold rolling process, extremely flexible by means of adaptation to the friction conditions. The dependence of the amount of lubricant on the changing process parameters can be readjusted on short notice. In general, this makes it possible to achieve frictional adaptation in the roll gap. The minimal lubrication is distinguished by the fact that only as much lubricant 9 is applied as is needed in the rolling process. In this connection, a so-called base oil can consist of various basic chemical substances; a "medium 1" for the minimal lubrication 17 can be mixed with a "medium 2" of various type classes x, y to produce a "medium n", until the necessary properties, e.g., viscosity and lubricity, for the minimal lubrication 17 are achieved. The process is continued on the run-out side 8*a* on the basis of the application of nitrogen and the application of alternative lubricants.

The process data suitable for this are summarized in FIG. 2: The "loop 1" packet contains (reading from left to right) the strip speed from the speed measuring instrument 12 and then the strip quality (e.g., fracture strength).

The strip thickness 15, the strip width 24, the strip flatness 25 from the flatness measuring instrument 11*a*, the strip surface (roughness) 26, and the strip tension distribution 27. The strip tension 28 is determined from the flatness measuring instrument 11*a*.

The parameters of the rolling force 29 result from the roll diameter 30, the roll roughness 31, the roll material 32, the rolling torque 33, the roll temperature 34, and the thickness reduction 35. The analogous values are provided on the runout side 8*a*.

The individual, independent preset values under consideration for the computer model 22 are summarized in FIG. 3: According to FIG. 3, the process data 23 are obtained from physical quantities, where additional subprograms (computer programs) are used in the computer model 22.

The pass program design 36 is optimized by a basic model. A tribological model 37 is used for evaluating the lubricating film. A temperature model 38 and the elastic deformation 39 of the rolls 3, 4, 5, 6 are introduced according to prior knowledge. A mechanical roll gap model 40 (computer program) is also taken into consideration. In addition, a model 41 for optimization of the surface quality is included in the computer model 22. The frictional adjustment to the rolling process 42 takes into consideration the conditions during reduction rolling, temper rolling, or flexible rolling. Also introduced are a hydrodynamic model 43 of the distribution of the lubricant 9 and a model (computer program) 44 for roughness impression (by the roll surface on the metal strip 2).

Preset values 45 for the rolling force 29 and the strip tension 28 are formed from the predetermined parameters for the computer model 22 (left part of FIG. 3). The closed-loop control systems for the strip thickness 15 and the strip flatness 25 and the strip surface with respect to roughness, luster, and other surface characteristics are individually set 46, and pass program optimization 47 is carried out with frictional adjustment to the individual rolling process.

A forecast 48 and optimization of the temperature development of the work rolls 3, 4 and the metal strip 2 are formed for the runout side 8*a* in FIG. 3 (right part). A lubricant determination 49 according to type, viscosity, and temperature is to be predetermined. In addition, optimization of the strip surface quality and a selection of the value for the work roll roughness are to be introduced.

List of Reference Numbers

1 rolling stand
2 metal strip
2*a* underside of rolling stock
2*b* upper side of rolling stock
3 upper work roll
4 lower work roll
5 upper backup roll
6 lower backup roll
7 uncoiling station
7*a* run-in side
8 coiling station
8*a* runout side
9 pure lubricant
10 coolant
11*a* flatness measuring instrument (run-in side)
11*b* flatness measuring instrument (runout side)
12 speed measuring instrument
13 strip speed
14 rolled strip quality
15 strip thickness
16 row of spray nozzles
17 amount, composition, and distribution of the minimal lubrication
18 upper row of spray nozzles (nitrogen application)
19 lower row of spray nozzles (nitrogen application)
20 nitrogen application
21 application of alternative lubricants
22 computer model (computer program)
23 process data
24 strip width
25 strip flatness
26 strip surface
27 strip tension distribution
28 strip tension
29 rolling force
30 roll diameter
31 roll roughness
32 roll material
33 rolling torque
34 roll temperature
35 thickness reduction
36 pass program design
37 tribological model (computer program)
38 temperature model (computer program)
39 elastic deformation of the roll
40 mechanical roll gap model (computer program)
41 model/surface quality
42 frictional adjustment to the rolling process
43 hydrodynamic model (computer program)
44 models for roughness impression
45 presetting rolling force/strip tension
46 setting of the level 1 automatic control systems
47 pass program optimization/adjustment
48 forecast of the temperature development
49 lubricant determination
50 optimization of the strip surface/work roll roughness

The invention claimed is:

1. A method for lubricating and cooling rolls (3, 4, 5, 6) and metal strip (2) during rolling in a rolling stand (1), where a lubricant (9) is applied by spraying at least on a run-in side (7*a*) and a coolant (10) is applied by spraying on a runout side (8*a*), and where the lubricant (9) and the coolant (10) consist of liquid substances with lubricating, cleaning, and inerting activity or a combination of these substances and are supplied to an underside (2*a*) of the metal strip (2) and/or to an upper side (2*b*) of the metal strip (2) and/or to the lower work roll (4) of the rolling stand (1) and/or to the upper work roll (3), wherein an amount of the pure lubricant applied on the run-in side (7*a*) is continuously computed and metered in such a way by means of a physical computer model (22) that is corresponded to a minimal amount of lubricant that is actually needed during the rolling, and where the physical computer model for a continuous computation of the minimal amount of lubricant continuously takes into account process data (23) of metal strip speed (13),
metal strip quality (14),
metal strip flatness (11*a*, 11*b*),
metal strip surface (26), and
metal strip tension (28), on the run-in side (7*a*) of the rolling stand (1) and the process data of
rolling force (29),
work roll diameter (30),
work roll roughness (31) and
roll material (32) on the runout side (8*a*) of the rolling stand (1).

2. A method in accordance with claim 1, wherein, during the rolling process, the following correcting variables for the application of the lubricants (9) and coolants (10) are preset on the basis of automatic control by the computer model (22):volume flow, pressure, temperature, different adjustments over the strip width (24), and if necessary, different adjustments for the underside (2*a*) and the upper side (2*b*) of the rolled strip.

3. A method in accordance with claim 1, wherein the mixing proportions of media are varied according to a computer program (22) of a physically based model.

4. A method in accordance with claim 1, wherein, before beginning the rolling operation, process data (23), including at least one of rolling force (29), strip tension (28), or strip thickness (15,) are preset in a pass program.

5. A method in accordance with claim 1, wherein process data (23) are used to preset a closed-loop control system for strip thickness (15), rolling stock elongation, strip flatness (25), strip roughness, and/or strip surface (26).

6. A method in accordance with claim 1, wherein a forecast (48) for optimization of temperature development in the metal strip (2) and/or in the work rolls (3, 4) is preset.

7. A method in accordance with claim 1, wherein a lubricant selection is made according to manufacturer's type, viscosity, and temperature behavior.

8. A method in accordance with claim 1, wherein the rolled strip surface is optimized (50) by selection of the work roll roughness.

9. A method in accordance with claim 1, wherein the above measures are also used during intervals with variable rolling speed with the use of the computer model (22).

10. A method for lubricating and cooling rolls (3, 4, 5, 6) and metal strip (2) during rolling in a rolling stand (1), where a lubricant (9) is applied by spraying at least on a run-in side (7*a*) and a coolant (10) is applied by spraying on a runout side (8*a*), and where the lubricant (9) and the coolant (10) consist of liquid substances with lubricating, cleaning, and inerting activity or a combination of these substances and are supplied to an underside (2*a*) of the metal strip (2) and/or to an upper side (2*b*) of the metal strip (2) and/or to the lower work roll (4) of the rolling stand (1) and/or to the upper work roll (3), wherein an amount of the pure lubricant applied on the run-in side (7*a*) is continuously computed and metered in such a way by means of a physical computer model (22) that it corresponds to a minimal amount of lubricant that is actually needed during the rolling, and where the physical computer model for a continuous computation of the minimal amount of lubricant continuously takes into account process data (23) of metal strip speed (13),
metal strip quality (14),
metal strip flatness (11*a*, 11*b*),
metal strip surface (26), and
metal strip tension (28), on the run-in side (7*a*) of the rolling stand (1) and the process data of
rolling force (29),
work roll diameter (30),
work roll roughness (31) and
roll material (32) on the runout side (8*a*) of the rolling stand (1), wherein the physical computer model (22) also takes the following variables into account:
prediction and optimization for a pass program design,
an evaluation of a lubricating film by a tribological model (37),
a temperature model (38),
the elastic deformation of the rolls (3, 4, 5, 6),
a mechanical roll gap model (40),
a model for optimization of the surface quality (41),
a frictional adjustment (42) to the rolling process during reduction rolling or temper rolling or flexible rolling,
a hydrodynamic model (43), and
a model (44) for roughness impression between the metal strip (2) and work rolls (3, 4).

* * * * *